US007901237B2

(12) United States Patent
Abe et al.

(10) Patent No.: US 7,901,237 B2
(45) Date of Patent: Mar. 8, 2011

(54) TOOL AND METHOD FOR ATTACHING AND DETACHING MODULAR PLUGS

(75) Inventors: Hiroyuki Abe, Kawasaki (JP); Fujio Ozawa, Kawasaki (JP); Kiyonori Kusuda, Kawasaki (JP); Tetsuya Murayama, Kawasaki (JP); Hiroshi Kadoya, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/686,591

(22) Filed: Jan. 13, 2010

(65) Prior Publication Data

US 2010/0190367 A1 Jul. 29, 2010

(30) Foreign Application Priority Data

Jan. 27, 2009 (JP) ..... 2009-015532

(51) Int. Cl.
*H01R 13/627* (2006.01)

(52) U.S. Cl. ..... 439/354; 439/701; 439/483; 439/923

(58) Field of Classification Search ..... 439/354, 439/483, 540.1, 701, 923
See application file for complete search history.

(56) References Cited

U.S. PATENT DOCUMENTS

| | | | | |
|---|---|---|---|---|
| 6,123,564 | A * | 9/2000 | Belmore, III | 439/344 |
| 6,547,585 | B2 * | 4/2003 | Bradley et al. | 439/353 |
| 7,374,447 | B2 * | 5/2008 | Matsumoto | 439/344 |
| 7,381,087 | B2 * | 6/2008 | Alvarez | 439/540.1 |

FOREIGN PATENT DOCUMENTS

JP 2006-19207 A 1/2006

* cited by examiner

*Primary Examiner* — Tho D Ta
(74) *Attorney, Agent, or Firm* — Fujitsu Patent Center

(57) ABSTRACT

A modular plug attaching and detaching tool includes a first holder configured to accommodate a plurality of modular plugs in an aligned state and a second holder configured to press unlocking claws of the plurality of modular plugs when the second holder is attached to the first holder. The first holder includes an engagement groove extending in an inserting direction of the modular plug. The second holder includes an engagement part configured to engage with the engagement groove of the first holder by being moved in the inserting direction.

8 Claims, 5 Drawing Sheets

TOOL AND METHOD FOR ATTACHING AND DETACHING MODULAR PLUGS

CROSS-REFERENCE TO RELATED APPLICATIONS

This application is based upon and claims the benefit of priority of the prior Japanese Patent Application No. 2009-015532, filed on Jan. 27, 2009, the entire contents of which are incorporated herein by reference.

FIELD

The embodiment discussed herein relates to a tool for attaching and detaching a modular plug to and from a modular jack.

BACKGROUND

As an interface for connecting a communication cable to communication equipments, a modular connector is used in many cases. Such a modular connector includes a pair of modular jack and modular plug so that a cable connection is achieved by inserting the modular plug into the modular jack.

Particularly, in recent communication equipments, because many communication cables must be connected to a communication equipment to construct a network such as a local area network (LAN), a connection using a modular connector, which allows a quick and reliable connection, has become mainstream. Moreover, a number of communication cables is increased with an increase in the size and functions of an equipment to which communication cables are connected, which results in an increase in the number of modular jacks mounted to an equipment.

In a case where a network is newly constructed by installing communication equipments or a network is restructured by changing communication equipments, communication cables must be connected to the communication equipments or disconnected from the communication equipments. That is, it is required to carry out an operation to attach modular plugs attached to ends of communication cables to modular jacks provided to the communication equipments or detach the modular plugs from the modular jacks.

The operation of attaching a modular plug to a modular jack can be achieved by merely inserting the modular plug into the modular jack. When the modular plug is inserted into the modular jack, a lock mechanism of the modular plug is operated to fix the modular plug to be in a state connected to the modular jack. On the other hand, an operation to detach the modular plug from the modular jack is achieved by pulling the modular plug out of the modular jack while unlocking the modular plug by pressing an unlocking claw of the modular plug.

When a number of communication cables connected is increased as mentioned above, the number of modular jacks is also increased, and if the modular plugs are detached from and attached to modular jacks one after another, an operation of connecting communication cables is complicated and it takes a long time to complete connection of all communication cables. For example, if a failure occurs in an equipment or an equipment needs to be changed, a maintenance operation must be performed while stopping an operation of the equipment. Thus, if the operation to disconnect and connect communication cables takes a long time, the maintenance operation also takes a long time, which results in an increase in a time to perform a maintenance operation. For example, in a case where a maintenance operation of a communication equipment for providing a communication service to the public is must be carried out, the communication service is stopped while the operation of the equipment is stopped, which comes into a state where the communication service is not provided to many users.

Therefore, in order to shorten a time to stop an operation of a communication equipment, it is desirable to shorten a time for disconnecting and connecting communication cables in the maintenance operation as much as possible. Thus, there is suggested a tool for detaching a plurality of modular plugs from modular jacks by pressing the unlocking claws of the modular plugs at once (for example, refer to Japanese Laid-Open Patent Publication No. 2006-19207).

When mounting a plurality of modular jacks to an equipment, the modular jacks are usually arranged in line on a front surface or a rear surface of the equipment. If the number of modular jacks is large, intervals between the adjacent modular jacks are narrow and it is difficult to easily perform an operation to pull the modular plugs from the modular jacks while pressing the unlocking claws of the modular plugs by a finger.

In many cases, a plurality of equipments having a reduced thickness are stacked one on another in a rack in multiple stages. In such a case, not only intervals of the modular plugs in a horizontal direction (left-to-right direction) but also intervals in a vertical direction are small. Thus, it becomes more difficult to perform an unlocking operation by pressing the unlocking claws of the modular plugs by a finger, which results in an increase in a time spent on an operation to pull and remove the modular plugs from the modular jacks.

The above-mentioned tool suggested in the Patent Document 1 to remove a plurality of modular plugs from modular jacks all together uses a mechanism to press the unlocking claws while holding the plurality of modular plugs between upper and lower adapters. Thus, if the intervals of the modular plugs in a vertical direction are narrow, the upper and lower adapters cannot be arranged above and under the modular plugs because they are blocked by the other modular plugs located above and under the modular plugs concerned and communication cables extending therefrom.

Accordingly, it is desirable to develop an attaching and detaching tool, which permits an operation of attaching and detaching a plurality of modular plugs at once even if many modular jacks are arranged horizontally and vertically close to each other.

SUMMARY

According to an aspect of the invention, a modular plug attaching and detaching tool includes: a first holder configured to accommodate a plurality of modular plugs in an aligned state; and a second holder configured to press unlocking claws of the plurality of modular plugs when the second holder is attached to the first holder, wherein the first holder includes an engagement groove extending in an inserting direction of the modular plugs, and the second holder includes an engagement part configured to engage with the engagement groove of the first holder by being moved in the inserting direction.

According to another aspect of the invention, a method of detaching a plurality of modular plugs from a plurality of modular jacks, includes: accommodating the plurality of modular plugs, which are connected to the modular jacks aligned in a line, in a first holder by moving the first holder relative to the modular plugs, the first holder being moved in an inserting direction of the modular plugs into the modular plugs; inserting an engagement part of a second holder into an engagement groove of the first holder by moving the second holder in the inserting direction relative to the first holder accommodating the plurality of modular plugs, and unlocking the modular plugs by pressing unlocking claws of the plurality of modular plugs by the second holder; and simultaneously pulling the plurality of modular plugs out of the modular jacks by moving the first and second holders in a detaching direction of the modular plugs from the modular jacks.

The object and advantages of the embodiment will be realized and attained by means of the elements and combinations particularly pointed out in the appended claims.

It is to be understood that both the foregoing general description and the following detailed description are exemplary explanatory only and are not restrictive of the invention, as claimed.

According to a further aspect of the invention, a method of attaching a plurality of modular plugs to a plurality of modular jacks, includes: accommodating a plurality of modular plugs in a first holder in a state where the modular plugs are aligned in a line, and pressing unlocking claws of the plurality of modular plugs by a second holder by attaching the second holder to the first holder; connecting the plurality of modular plugs to the modular jacks in a state where the modular plugs are accommodated in the first holder; locking the plurality of modular plugs to the modular jacks by canceling a pressing force to the unlocking claws by moving said second holder in a direction opposite to the inserting direction of the modular plugs to remove the second holder from the first holder; and removing the first holder from the plurality of modular plugs.

DESCRIPTION OF EMBODIMENT(S)

Preferred embodiment of the present invention will be explained with reference to the accompanying drawings.

Figure 1A:
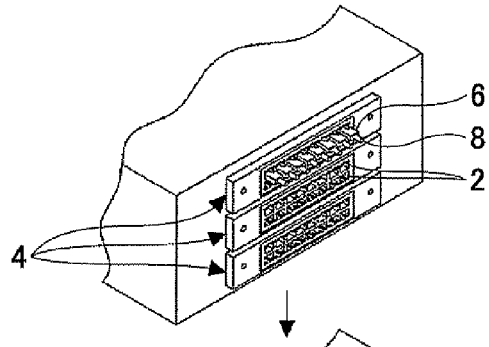
FIGS. 1A through 1E are perspective views of an equipment having many modular jacks for explaining processes of an operation to remove the modular plugs by using a modular plug attaching and detaching tool according to an embodiment.

FIGS. 1A through 1E are perspective views of equipments having many modular jacks for explaining processes of an operation to remove the modular plugs by using a modular plug attaching and detaching tool according to an embodiment. In FIGS. 1A through 1E, three equipments 4 each having a plurality of modular jacks 2 are stacked one on another. Each of the equipments 4 is provided with two lines of modular jacks 2, eight modular jacks 2 being provided in the upper line and another eight modular jacks 2 being provided in the lower line. FIG. 1A illustrates a state where eight modular plugs 6 are attached to the eight modular jacks 2 in the upper line of the uppermost equipment 4, respectively.

Although communication cables 8, which extend from the modular plugs 6, are illustrated in a state where they are cut in a short length in FIGS. 1A through 1E for the sake of simplification of the illustration, the communication cables 8 are actually longer than illustrated and extend on the front side of the equipments 4. Moreover, actually, the modular plugs 6 are provided to all of the modular jacks 2 of the three equipments 4, and the communication cables 8 extend from all of the modular plugs 6. Thus, many communication cables 8 extend on the front side of the equipment 4, which results in a state where the modular plugs 6 of lines below the uppermost line of the modular plugs 6 are covered by the communication cables 8 and hardly seen.

Figure 1B:
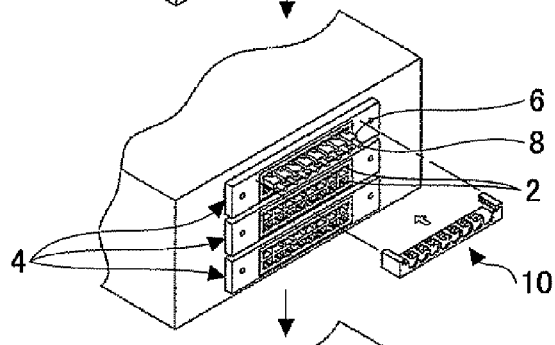
Figure 1C:
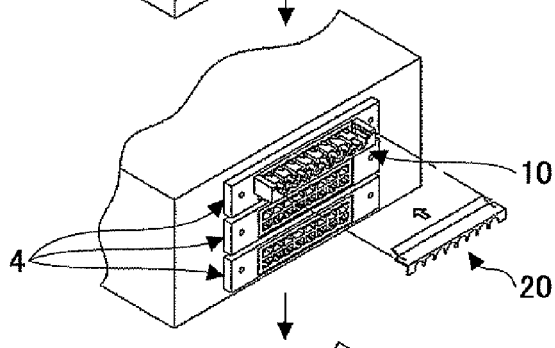

The modular plug attaching and detaching tool according to the present embodiment includes a support tool 10 (a first holder) illustrated in FIG. 1B and a slide plate 20 (a second holder) illustrated in FIG. 1C. As illustrated in FIG. 1B, the support tool 10 is arranged under the eight modular plugs 6 in a line. As illustrated in FIG. 1C, the slide plate 20 is arranged above the modular plugs 6 while engaging with the support tool 10.

Figure 2A:
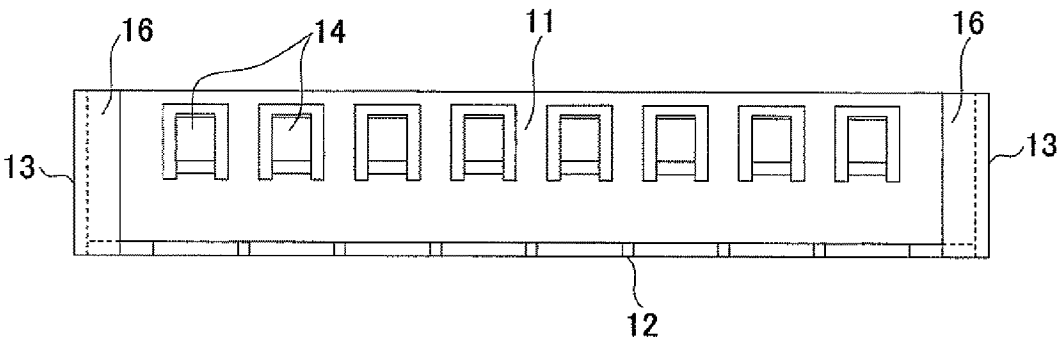
FIG. 2A is a plan view of a holder of the modular plug attaching and detaching tool according to the embodiment.
Figure 2B:
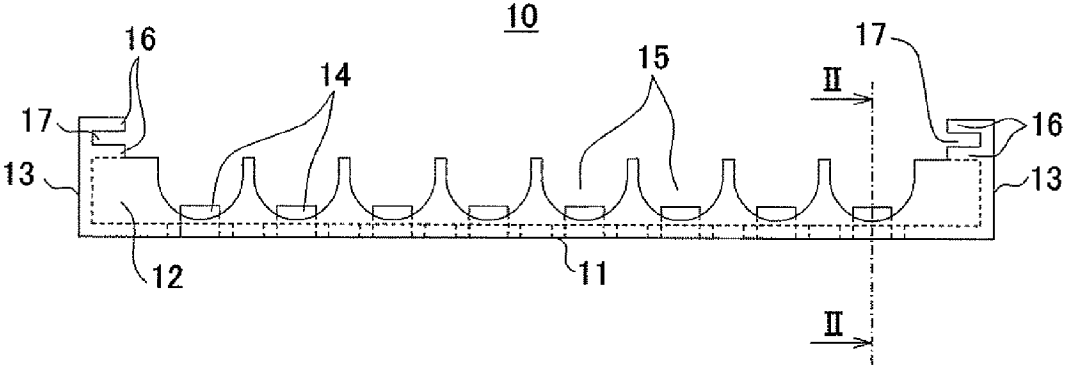
FIG. 2B is a front view of the holder of the modular plug attaching and detaching tool.
Figure 2C:
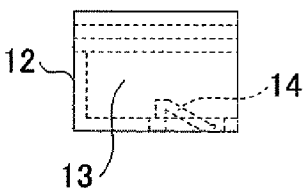
FIG. 2C is a side view of the holder of the modular plug attaching and detaching tool.
Figure 2D:
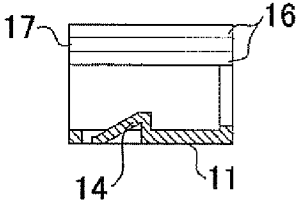
FIG. 2D is a cross-sectional view of the holder of the modular plug attaching and detaching tool taken along a line II-II of FIG. 2B.

Here, a description will be given of the support tool 10 as a first holder. FIGS. 2A through 2D are enlarged views of the support tool 10. FIG. 2A is a plan view of the support tool 10, FIG. 2B is a front view of the support tool 10, FIG. 2C is a side view of the support tool 10, and FIG. 2D is a cross-sectional view of the support tool 10 taken along a line II-II of FIG. 2B.

Although it is desirable to form the support tool 10 by processing a metal plate such as, for example, a stainless steel plate or a galvanized steel plate, the support tool 10 may be formed by other material such as, for example a resin. In the present embodiment, it is assumed that the support tool 10 is formed by processing a stainless steel plate.

Figure 1D:
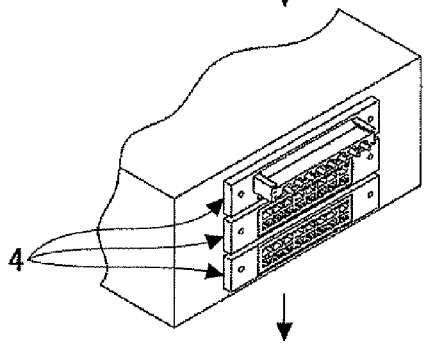
Figure 1E:
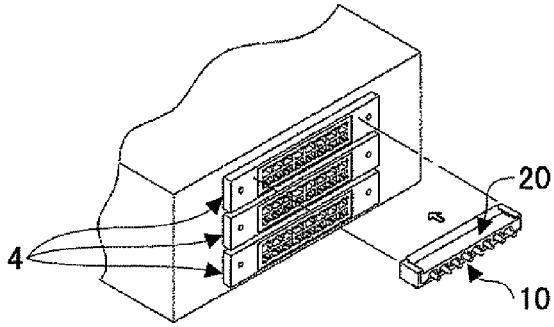

The support tool 10 includes a bottom plate 11, a front plate 12 extending perpendicularly from a front side of the bottom plate 11, and a side plates 13 extending perpendicularly from left and right sides of the bottom plate 11. The bottom plate 11 has a sufficient length to support the eight modular plugs 6 all together as illustrated in FIG. 1D. The bottom plate 11 is provided with eight engagement protruding parts 14 in response to the eight modular plugs 6 to be supported. The engagement protruding parts 14 can be formed by bending portions of the stainless steel plate corresponding to the bottom plate 11 inwardly. The support tool 10 is attached to the modular plugs 6 by the engagement protruding parts 14 being brought into engagement with engagement recessed parts of the respective modular plugs 6.

Notches 15 are formed in the front plate 12 in response to the corresponding modular plugs 6. When the support tool 10 accommodates the modular plugs 6, the communication cables 8 extending from the modular plugs 6 can extend outside the support tool 10 through the notches 15.

Two overhang parts 16 are formed in each of the left and right side plates 13 to extend inwardly parallel to each other so that an engagement groove 17, which extends in an inserting direction of the modular plugs 6 into the modular jacks 2, is formed between the two overhang parts 16. An interval of the two overhang parts 16 is set to a dimension (that is, a width of the engagement groove 17) is set to a dimension by which the slide plate 20 mentioned later can be inserted therein.

Figure 3A:
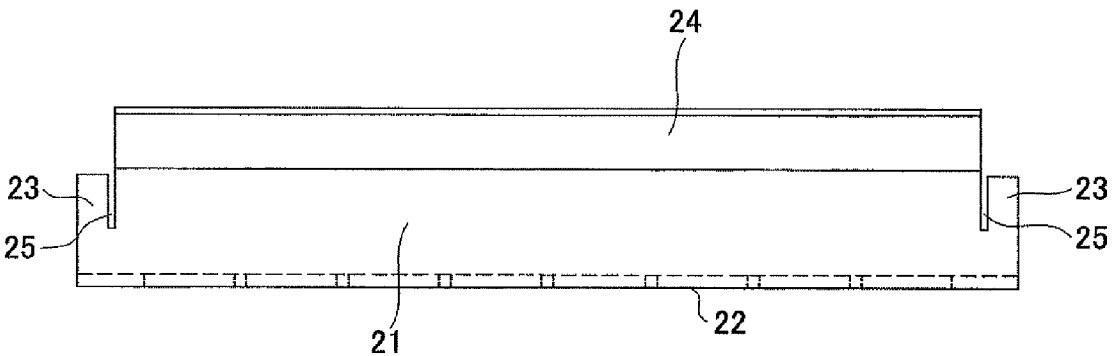
FIG. 3A is a plan view of a slide plate of the modular plug attaching and detaching tool according to the embodiment.
Figure 3B:
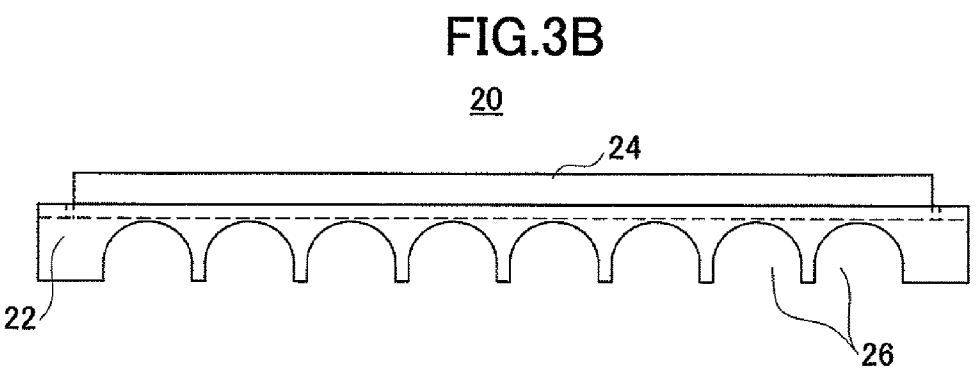
FIG. 3B is a front view of the slide plate of the modular plug attaching and detaching tool.
Figure 3C:
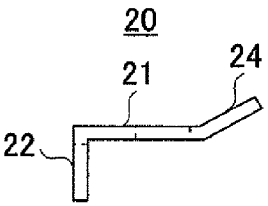
FIG. 3C is a side view of the slide plate of the modular plug attaching and detaching tool.

A description will be given of the slide plate 20 as a second holder. FIG. 3A is a plan view of the slide plate 20, FIG. 3B is a front view of the slide plate 20, and FIG. 3C is a side view of the slide plate 20.

Although it is desirable to form the slide plate 20 by processing a metal plate such as, for example, a stainless steel plate or a galvanized steel plate, the slide plate 20 may be formed by other materials such as, for example, a resin if they can be sufficiently thin and have a sufficient strength. In the present embodiment, it is assumed that the slide plate 20 is formed by processing a stainless steel plate.

The slide plate 20 includes a top plate 21 and a front plate 22 extending perpendicularly from the top plate 21. An engagement part 23 is formed on each of the left and right ends of the top plate 21. The engagement part 23 is a portion, which is inserted into the engagement groove 17 of the support tool 10.

An oblique plate 24 is formed on a rear side of the top plate 21 (that is, a side opposite to the side were the front plate 22 extends). The oblique plate 24 is provided for contacting and pressing the unlocking claws of the eight modular plugs 6 accommodated in the support tool 10. Slits (or notches) 25 are provided to the top plate 21 at positions corresponding to each end of the oblique plate 24 so that the engagement parts 23 are separated from the top plate 21 from which the oblique plate 24 extends. Thereby, the portion of the top plate 21 from which the oblique plate 24 extends is elastically deformable even when the engagement parts 23 are inserted into the engagement grooves 17 of the support tool 10 to fix the slide plate 20. Thus, the unlocking claws of the modular plugs 6 can be pressed appropriately by the oblique plate 24 and the portion of the top plate 21 from which the oblique plate 24 extends. That is, by providing the slits 25 to the top plate 21, the portion of the top plate 21 from which the oblique plate 24 extends is elastically and slightly deformable in a direction opposite to the direction in which the unlocking claws of the modular plugs 6 are pressed so that the unlocking claws are not damaged due to the unlocking claws being pressed with an excessively strong force.

Similar to the front plate 12 of the support tool 10, the front plate 22 of the slide plate 20 is provided with notches 26 in at positions corresponding to the modular plugs 6. When the slide plate 20 is attached to the support tool 10, the communication cables 8 extending from the modular plugs 6 accommodated in the support tool 10 can extend outside the support tool 10 and the slide plate 20 through the notches 26.

A description will now be given, with reference to FIGS. 1A through 1E and FIGS. 4A through 4E, of a method of detaching the modular plugs from the modular jacks by using the modular plug attaching and detaching tool according to the present embodiment. FIGS. 4A through 4E are illustrations illustrating processes of an operation to detach the modular plugs from the modular jacks by using the support tool 10 and the slide plate 20 illustrated in FIGS. 2A through 2D and FIGS. 3A through 3C. FIGS. 4A through 4E correspond to FIGS. 1A through 1E, respectively.

FIGS. 1A through 1E illustrate a detachment of the modular plugs 6 from the modular jacks 2 of an upper line of the two lines of the modular jacks 2 provided in the single equipment 4 by pulling the modular plugs 6 out of the modular jacks 2. The difference between the upper line and the lower line of the modular jacks 2 is that the modular jacks 2 on the lower line are positioned upside down relative to the modular jacks 2 on the upper line. The detachment actions of the modular plugs 6 from the modular jacks 2 on the upper line and the lower line are the same.

Figure 4A:
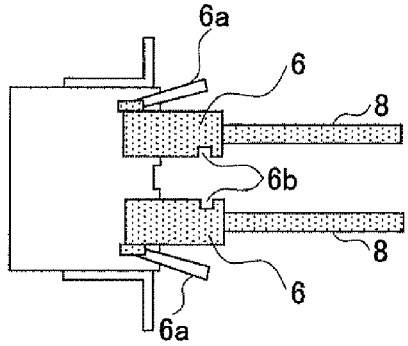
FIGS. 4A through 4E are illustrations illustrating processes of an operation to detach the modular plugs by using the holder and the slide plate illustrated in FIGS. 2A through 2D and FIGS. 3A through 3C.
Figure 4B:
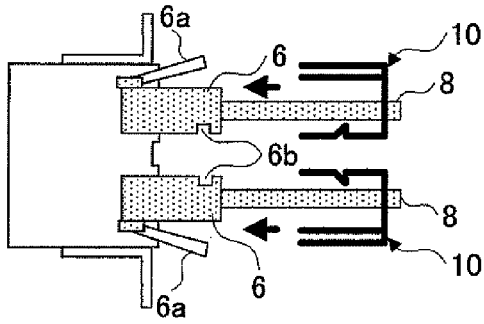

As illustrated in FIG. 1A, it is assumed that the modular plugs 6 are inserted into and attached to the modular jacks 2, as illustrated in FIG. 1A. FIG. 4A corresponds to an illustration of the state of FIG. 1A. FIG. 4A illustrates a normal state where the unlocking claws 6*a* of the modular plugs 6 are not pressed and the modular plugs 6 are locked in the state where the modular plugs 6 are inserted in the respective modular jacks 2. An engagement recessed part 6*b* is provided to each modular plug 6 on a side opposite to the unlocking claw 6*a*.

First, as illustrated in FIG. 1B and FIG. 1C, the support tool 10 is arranged to the modular plugs 6 so as to accommodate the modular plugs 6 in the support tool 10. In the example illustrated in FIGS. 1A through 1E, eight modular jacks 2 are aligned on a line, and, thus, eight modular plugs 6 are provided in a line and the eight modular plugs 6 are accommodated all together in the support tool 10. Because the support tool 10 is formed by a stainless steel plate and the thickness of the support tool 10 is thin, the support tool 10 can be easily inserted between the modular plugs 6 and the communication cables 8 on the upper line and the lower line. The support tool 10 can be easily moved to a position where the modular plugs 6 are accommodated in the support tool 10 by moving the support tool 10 toward the modular plugs 6. At this time, the engagement protruding parts 14 provided in the bottom surface 11 of the support tool 10 is brought into engagement with the engagement recessed parts 6*b* of the corresponding modular plugs 6 (refer to FIG. 4C). Thereby, the support tool 10 is fixed to the modular plugs 6 in the state where the modular plugs 6 are accommodated in the support tool 10.

Figure 4C:
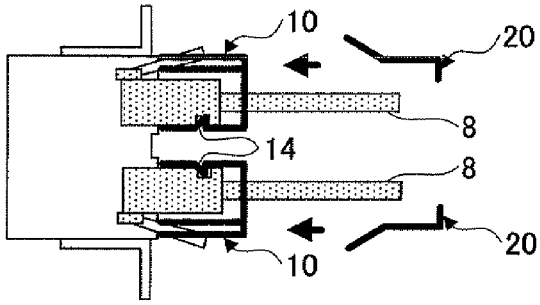
Figure 4D:
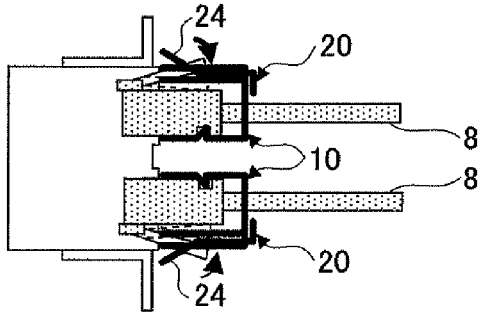

After the support tool 10 is fixed to the modular plugs 6 attached to the modular jacks 2, the slide plate 20 is attached to the modular plugs 6 accommodated in the support tool 10 as illustrated in FIG. 4C and FIG. 4D. That is, the slide plate 20 is moved in an inserting direction of the modular plugs 6 toward a position above the support tool 10 in the state where the communication cables 8 are inserted into the notches 26 provided in the front plate 22 of the slide plate 20. Then, the slide plate 20 is pressed into while inserting the engagement parts 23 of the slide plate 20 into the respective engagement grooves 17. At this time, the surface of the oblique plate 24 of the slide plate 20 is brought into contact with the unlocking claws 6*a* of the modular plugs 6, and the unlocking claws 6*a* slides on the oblique plate 24 and are pressed while the slide plate 20 is pressed into. When the slide plate 20 is pressed into to the end, the unlocking claws 6*a* are completely pressed down by the slide plate 20, which results in unlocking the modular plugs 6 (the state illustrated in FIG. 4D in which the unlocking claws 6*a* completely pressed down are indicated by dotted lines).

Figure 4E:
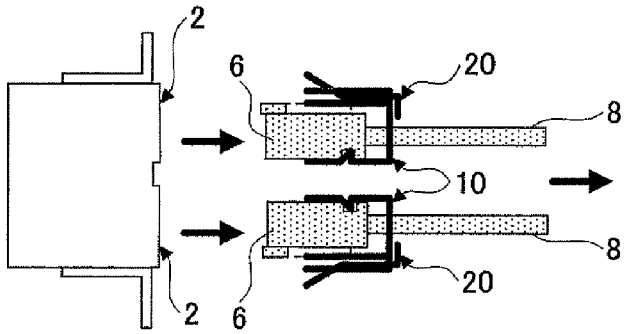

After the modular plugs 6 are unlocked, the eight modular plugs 6 can be pulled out of the modular jacks 2 all together by pulling the support tool 10 and the slide plate 20 in a direction of detaching the modular plugs 6 as illustrated in FIG. 4E. That is, because the modular plugs 6 are accommodated in the support tool 10 and the engagement protruding parts 14 are in engagement with the engagement recessed parts 6*b*, if the support tool 10 is pulled, the eight modular plugs 6 are pulled simultaneously and removed from the modular jacks as illustrated in FIG. 4E.

As mentioned above, by attaching the slide plate 20 to the support tool 10 after positioning the support tool 10 relative to the modular plugs 6 to be detached, the unlocking claws 6*a* are pressed down and the modular plugs 6 are fixed to the support tool 10. Accordingly, by merely pulling the support tool 10, the eight modular plugs 6 can be pulled out of the modular jacks 2 all together. In order to attach the support tool 10 to the modular plugs 6 and attach the support part 10 to the slide plate 20, it is necessary to merely move the support tool 10 and slide plate 20 in the inserting direction of the modular plugs 6. Accordingly, there is no need to keep a large space above and under the modular plugs 6, and the support tool 10 and the slide plate 20 can be easily inserted between the modular plugs 6 even if the modular plugs 6 are arranged vertically close to each other at small intervals.

A description will be given below, with reference to FIGS. 5A through 5D, of a method of simultaneously attaching a plurality of modular plugs to a plurality of modular jacks all together by using the modular plug attaching and detaching tool according to the present embodiment. FIGS. 5A through 5D illustrate an operation to simultaneously attach the eight modular plugs 6 to the modular jacks 2 by using the support tool 10 and the slide plate 20 illustrated in FIGS. 2A through 2D and FIGS. 3A through 3C. Basically, the attaching operation can be performed in a reverse way of the detaching operation illustrated in FIGS. 1A through 1E and FIGS. 4A through 4E.

Figure 5A:
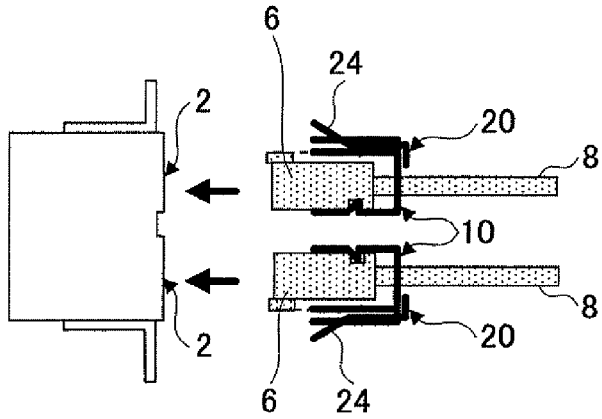
FIGS. 5A through 5D are illustrations illustrating processes of an operation to attach the modular plugs by using the holder and the slide plate illustrated in FIGS. 2A through 2D and FIGS. 3A through 3C.

First, as illustrated in FIG. 5A, eight modular plugs 6 to be attached are inserted into and attached to the support tool 10 having the slide plate 20 attached thereto. When inserting the modular plugs 6, the unlocking claws 6*a* of the modular plugs 6 are moved along the oblique plate 24 and pressed down. Thereby, the locking mechanisms of the modular plugs 6 are turned into an unlocked state, which is a state where the modular plugs 6 can be inserted into the modular jacks 2.

Figure 5B:
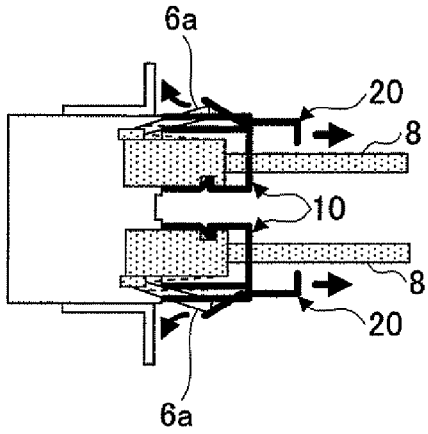

Then, the eight modular plugs 6 are moved together with the slide plate 20 and the support tool 10 in the inserting direction so as to insert the modular plugs 6 into the modular jacks 2. Then, as illustrated in FIG. 5B, the slide plate 20 is removed from the support tool 10 while the modular plugs 6 are inserted in the modular jacks 2. Thus, the unlocking claws 6*a* of the modular plugs 6, which have been pressed down by the top plate 21 of the slider 20, return to the initial locking positions because the slider 20 is removed. Thereby, the modular plugs 6 are locked to the modular jacks 2, and the connection (attachment) of the modular plugs 6 is completed.

Figure 5C:
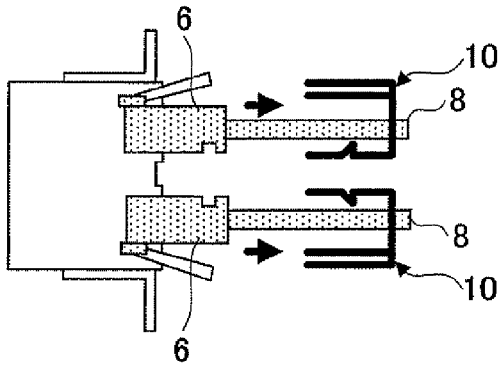
Figure 5D:
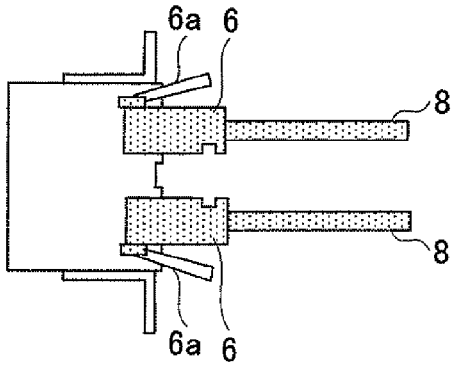

Then, as illustrated in FIG. 5C, the engagement between the engagement protruding parts 14 of the support tool 10 and the engagement recessed parts 6*b* of the modular plugs 6 is cancelled, and the support tool 10 is removed from the modular plugs 6. Thereby, as illustrated in FIG. 5D, the attachment of the modular plugs 6 to the modular jacks 2 is completed.

As mentioned above, by attaching the modular plugs 6 to the support tool 10 after attaching the slider 20 to the support tool 10, the unlocking claws 6*a* are pressed down and the modular plugs 6 are fixed to the support tool 10. Accordingly, the eight modular plugs 6 can be simultaneously attached to the modular jacks 2 all together by pressing the eight modular plugs 6 into the modular jacks 2 together with the support tool 10. In order to remove the slide plate 20 from the support tool 10 and remove the support tool 10 from the modular plugs 6, it is required to merely move the slide plate 20 and the support tool 10 in the detaching direction of the modular plugs 6. Accordingly, there is no need to keep a large space above and under the modular plugs 6, and the support tool 10 and the slide plate 20 can be easily removed from a position between the modular plugs 6 even if the modular plugs 6 are arranged vertically close to each other at small intervals.

Although eight pieces of the modular plug 6 are aligned in a line and attached to the modular jacks 2 all together in the present embodiment, the number of modular plugs 6 is not limited to eight, and the modular plug attachment and detachment tool may accommodate an arbitrary number of modular plugs 6.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention(s) has(have) been described in detail, it should be understood that the various changes, substitutions, and alterations could be made hereto without departing from the spirit and scope of the invention.

What is claimed is:

1. A modular plug attaching and detaching tool comprising:

a first holder configured to accommodate a plurality of modular plugs in an aligned state; and a second holder configured to press unlocking claws of said plurality of modular plugs when the second holder is attached to said first holder, wherein said first holder includes an engagement groove extending in an inserting direction of said modular plugs, and said second holder includes an engagement part configured to engage with said engagement groove of said first holder by being moved in the inserting direction.

2. The modular plug attaching and detaching tool according to claim 1, wherein said first holder includes engagement protruding parts that engages with engagement recessed parts of said modular plugs accommodated therein, respectively.

3. The modular plug attaching and detaching tool according to claim 1, wherein said engagement groove of said first holder is formed on each of opposite ends of said first holder in an aligning direction of said modular plugs, and said engagement part of said second holder is formed on each of opposite ends of said second holder in the aligning direction of said modular plugs.

4. The modular plug attaching and detaching tool according to claim 3, wherein said second holder includes an oblique part extending oblique to the inserting direction of said modular plugs so as to press said unlocking claws of said modular plugs by the oblique part moving in the inserting direction.

5. The modular plug attaching and detaching tool according to claim 4, wherein said second holder includes a slit at a position corresponding to each of opposite ends of said oblique part in the aligning direction of said modular plugs.

6. The modular plug attaching and detaching tool according to claim 1 wherein said first and second holders are formed by a metal plate.

7. A method of detaching a plurality of modular plugs from a plurality of modular jacks, comprising:

accommodating said plurality of modular plugs, which are connected to said modular jacks aligned in a line, in a first holder by moving the first holder relative to said modular plugs, the first holder being moved in an inserting direction of said modular plugs into said modular plugs;

inserting an engagement part of a second holder into an engagement groove of said first holder by moving said second holder in the inserting direction relative to said first holder accommodating said plurality of modular plugs, and unlocking said modular plugs by pressing unlocking claws of said plurality of modular plugs by said second holder; and simultaneously pulling said plurality of modular plugs out of said modular jacks by moving said first and second holders in a detaching direction of said modular plugs from said modular jacks.

8. A method of attaching a plurality of modular plugs to a plurality of modular jacks, comprising:

accommodating a plurality of modular plugs in a first holder in a state where said modular plugs are aligned in line, and pressing unlocking claws of said plurality of modular plugs by a second holder by attaching said second holder to said first holder;

connecting said plurality of modular plugs to said modular jacks in a state where said modular plugs are accommodated in said first holder;

locking said plurality of modular plugs to said modular jacks by canceling a pressing force to said unlocking claws by moving said second holder in a direction opposite to the inserting direction of said modular plugs to remove said second holder from said first holder; and removing said first holder from said plurality of modular plugs.

* * * * *